US006973907B2

(12) United States Patent
Satou

(10) Patent No.: US 6,973,907 B2
(45) Date of Patent: Dec. 13, 2005

(54) CYLINDER BLOCK FOR INTERNAL-COMBUSTION ENGINE

(75) Inventor: Naoyuki Satou, Tokyo (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/960,691

(22) Filed: Oct. 8, 2004

(65) Prior Publication Data

US 2005/0076862 A1 Apr. 14, 2005

(30) Foreign Application Priority Data

Oct. 10, 2003 (JP) ..... 2003-351579

(51) Int. Cl.[7] ..... F02F 7/00; F16M 1/00
(52) U.S. Cl. ..... 123/195 R; 123/193.2
(58) Field of Search ..... 123/195 R, 196 R, 123/41.72, 41.74, 193.2, 193.3

(56) References Cited

U.S. PATENT DOCUMENTS 4,712,517 A 12/1987 Anno et al.
5,501,189 A * 3/1996 van Bezeij ..... 123/193.1
6,065,458 A 5/2000 Ozeki
6,152,090 A * 11/2000 Fujimoto et al. ..... 123/41.74
6,158,402 A 12/2000 Taguchi et al.
6,283,081 B1 9/2001 Ozeki
6,837,208 B2 * 1/2005 Satou ..... 123/195 R

FOREIGN PATENT DOCUMENTS

DE 19943245 A1 3/2001
DE 10258882 A1 7/2004
EP 1314878 A2 5/2003
JP 2002-115600 A 4/2002

* cited by examiner

*Primary Examiner*—Weilun Lo
(74) *Attorney, Agent, or Firm*—Foley & Lardner LLP

(57) ABSTRACT

In a cylinder block for an internal-combustion engine, a cap-mounting bulk portion is connected with both first and second side walls of a crankcase formed below a lower deck. Each of first and second bulk connection portions connecting the first and second side walls, respectively, with the cap-mounting bulk portion projects inwardly from the corresponding side wall. The bulk connection portion is formed with a hollow portion extending in a vertical direction of the cylinder block. The first and second bulk connection portions are connected, respectively, with first and second head bolt bosses, which are formed on an upper block wall surrounding an upper part of a cylinder of the engine, by first and second connecting ribs extending in the vertical direction.

9 Claims, 4 Drawing Sheets

CYLINDER BLOCK FOR INTERNAL-COMBUSTION ENGINE

BACKGROUND OF THE INVENTION

The present invention generally relates to a cylinder block for a water-cooled internal-combustion engine, and more particularly, to technique for enhancing rigidity of a cap-mounting bulk portion and its connection portion to the cylinder block.

Japanese Patent Application Publication No. 2002-115600 discloses a cylinder block structure for an internal-combustion engine. In the internal-combustion engine, cap-mounting bulk portions are formed in a cylinder block. Bearing caps are fastened immovably to the cap-mounting bulk portions to sandwich a crankshaft. Thus, the cap-mounting bulk portions and the bearing caps rotatably support the crankshaft. Each of the cap-mounting bulk portions has both ends connected integrally with both side walls of a crankcase formed below a lower deck. Thus, the cap-mounting bulk portions extend between both side walls of the crankcase.

SUMMARY OF THE INVENTION

In the above-mentioned structure, a large magnitude of firing pressure and inertial force from the crankshaft is likely to apply an intensive stress on bulk connection portions each connecting the cap-mounting bulk portion with either of the side walls of the crankcase, and therefore, the bulk connection portions need to be formed with high strength or rigidity by increasing wall thickness of the bulk connection portions, which may cause increase in weight or size of the structure, or cause cast defects, such as shrinkage.

It is an object of the present invention to provide technique for increasing rigidity of cap-mounting bulk connection portions without causing an increase in weight or size of the portions or causing cast defects of the portions.

According to one aspect of the present invention, a cylinder block for an internal-combustion engine, including: an upper block wall surrounding an upper part of a cylinder of the engine, and including first and second upper side walls on first and second sides of the cylinder; a crankcase including first and second side walls formed, respectively, on the first and second sides; first and second head bolt bosses formed, respectively on first and second sides, each head bolt boss projecting from the upper block wall and including a head bolt hole opening in a top deck of the cylinder block; a cap-mounting bulk portion extending between the first and second side walls of the crankcase, and arranged to support a crankshaft rotatably with a bearing cap; first and second bulk connection portions projecting, respectively, from the first and second side walls of the crankcase, to the cap-mounting bulk portion, and thereby connecting the cap-mounting bulk portion, respectively with the first and second side walls of the crankcase, each of the first and second bulk connection portions being formed with a hollow portion extending in a vertical direction of the cylinder block; and first and second connecting ribs extending in the vertical direction and connecting the first and second bulk connection portions, respectively, with the first and second head bolt bosses.

The other objects and features of this invention will become understood from the following description with reference to the accompanying drawings.

DETAILED DESCRIPTION OF THE INVENTION

Figure 1:
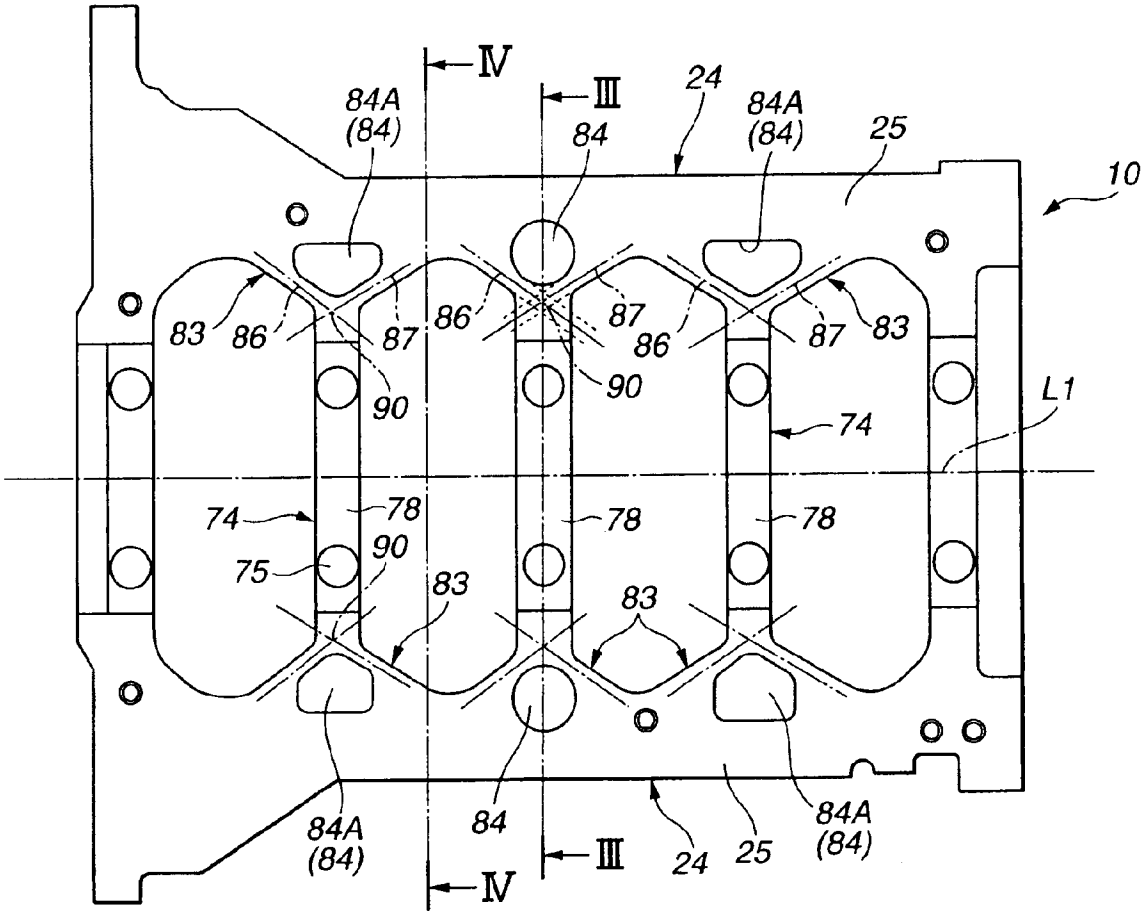
FIG. 1 is a bottom view showing a cylinder block for an internal-combustion engine according to an embodiment of the present invention.
Figure 2:
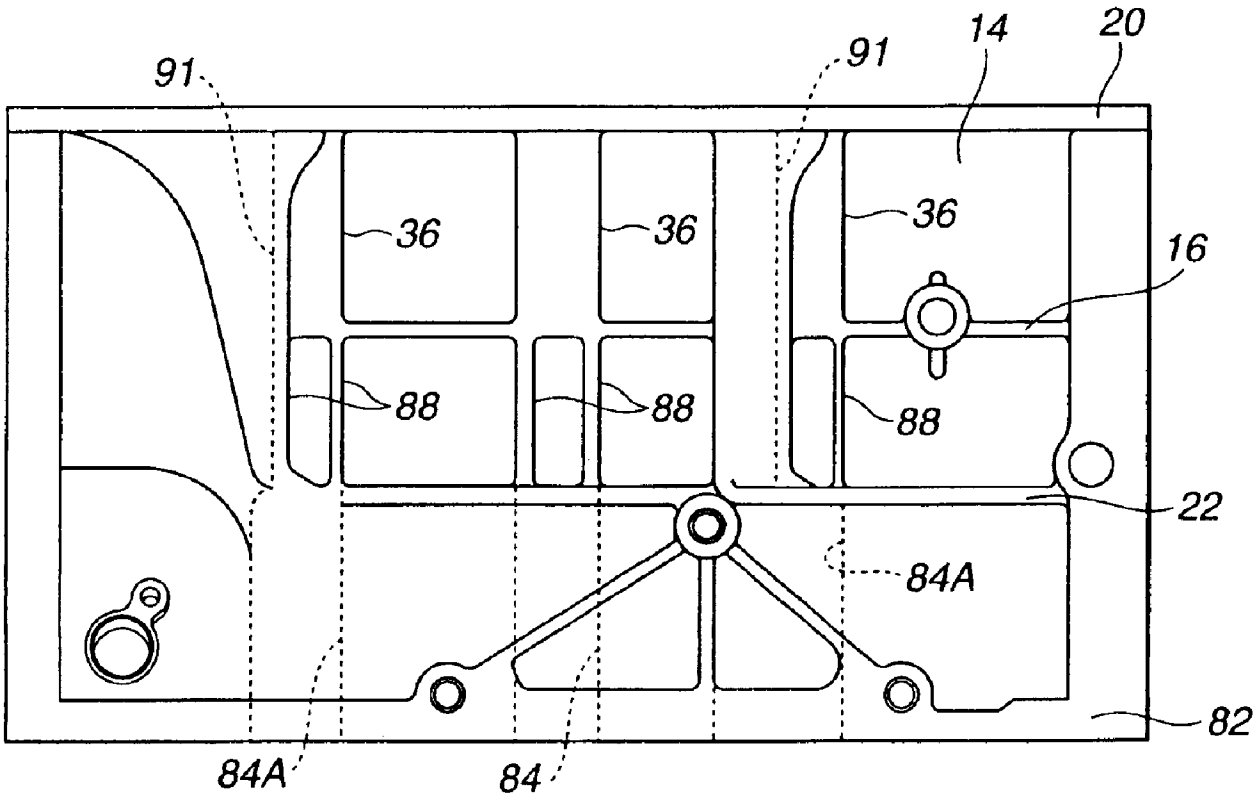
FIG. 2 is a right side view showing the cylinder block of FIG. 1.
Figure 3:
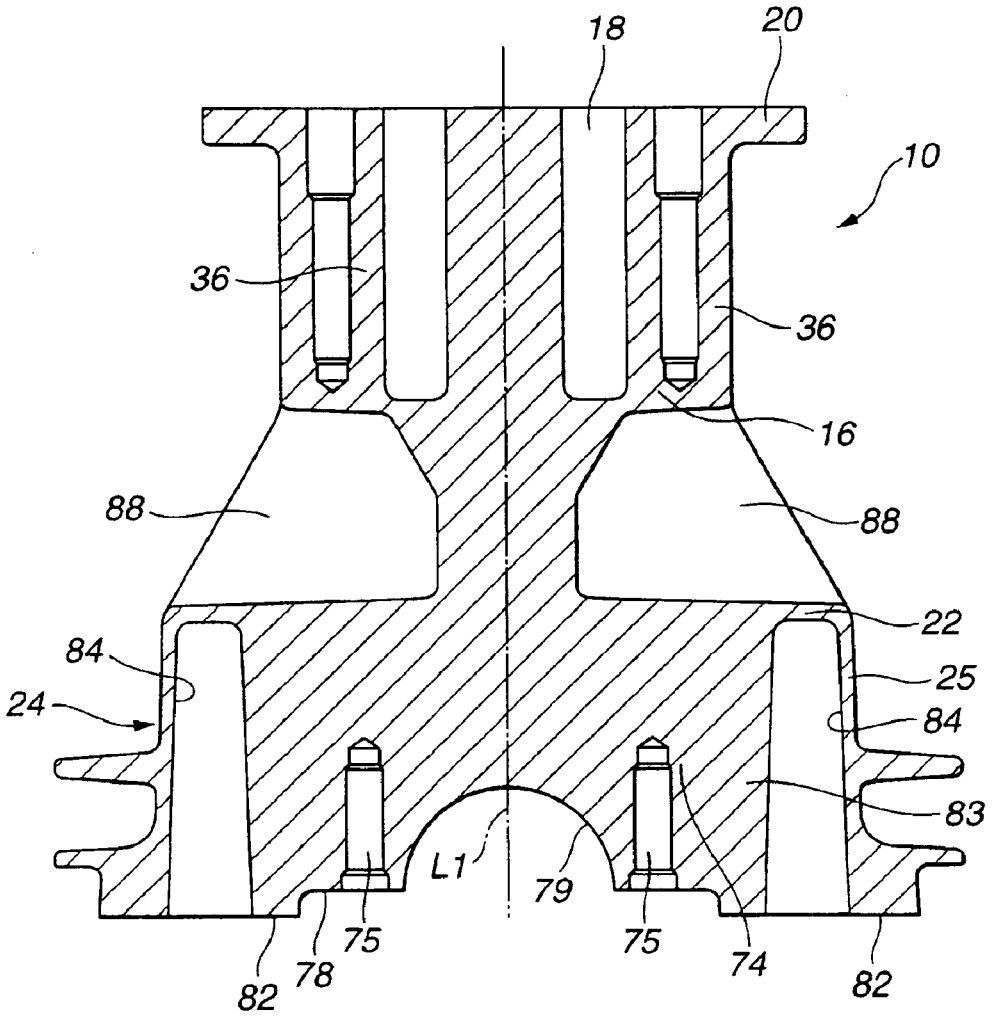
FIG. 3 is a sectional view taken along a line III—III in FIG. 1.
Figure 4:
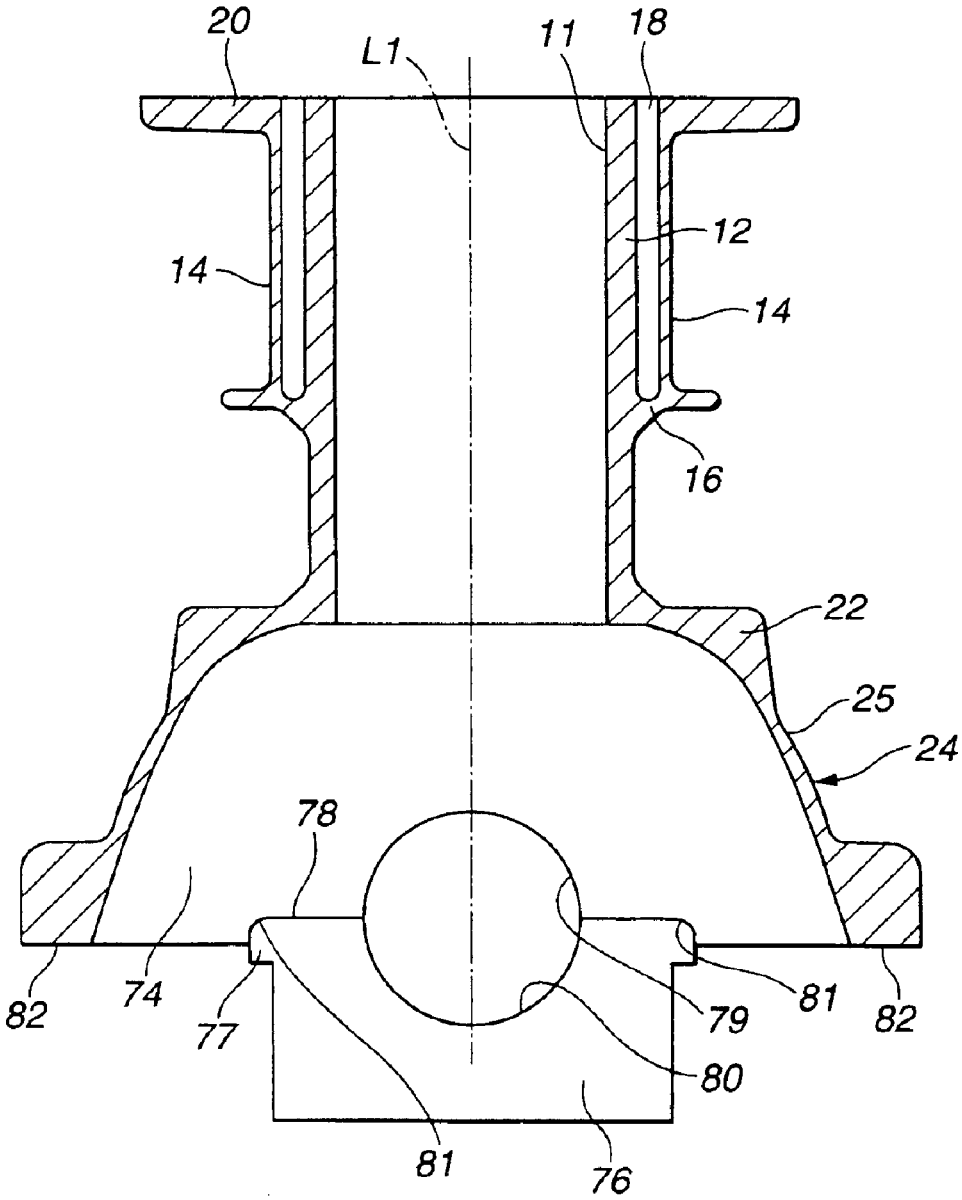
FIG. 4 is a sectional view taken along a line IV—IV in FIG. 1.

FIG. 1 is a bottom view showing a cylinder block 10 for an internal-combustion engine according to an embodiment of the present invention. FIG. 2 is a right side view showing the cylinder block of FIG. 1. FIG. 3 is a sectional view taken along a line III—III in FIG. 1. FIG. 4 is a sectional view taken along a line IV—IV in FIG. 1.

The internal-combustion engine of this example is an inline four-cylinder, water-cooled internal-combustion engine, and is transversely-mounted on a vehicle with an intake side located forward and an exhaust side located rearward on the vehicle. Cylinder block 10 of this example is formed integrally by aluminum die-casting, and includes cylinder walls 12 and a side jacket wall 14 surrounding the upper portion of cylinder walls 12. Each of cylinder walls 12 is formed with a cylinder bore 11 to receive a piston and allow the piston to move up and down within. Thus, cylinder bores 11, formed in corresponding cylinder walls 12, are arranged in line in a longitudinal direction of cylinder block 10. Cylinder block 10 also includes a water jacket 18 formed between an upper circumference of cylinder walls 12 and side jacket wall 14, and includes a top deck 20 and a lower deck 22 formed at upper and lower ends, respectively, of cylinder walls 12, as shown in FIG. 4. Each of top deck 20 and lower deck 22 is formed in a flange form projecting outward in a lateral direction of cylinder block 10. Each of cylinder walls 12 extends from top deck 20 to lower deck 22 in a vertical direction of cylinder block 10. Water jacket 18 forms a cast hole including an upper end opening to top deck 20 in an open-deck form. Water jacket 18 contains cooling water to circulate therein to cool down cylinder wall 12 by dissipating heat therefrom.

Cylinder block 10 has a siamese form in which parts of adjacent cylinder walls 12 arranged in line in the longitudinal direction are joined to one another to shorten the distance between cylinder bores 11. Cylinder walls 12 in one example serves as a cast-iron liner around which casting is formed integrally. In another example, cylinder walls 12 are cast integrally from abrasion resistant aluminum.

In this example, side jacket wall 14 forms an upper side wall or upper block wall of cylinder block 10. In another example, cylinder block 10 may further include an upper side wall or upper block wall outside side jacket wall 14.

Cylinder block 10 also includes a jacket bottom wall 16 forming a bottom of water jacket 18. Jacket bottom wall 16 is formed in a flange form projecting outward in the lateral direction of cylinder block 10, as shown in FIG. 4. Jacket bottom wall 16 connects a lower end of side jacket wall 14 with a middle portion of cylinder wall 12. Jacket bottom wall 16 is spaced from lower deck 22 in the vertical direction of cylinder block 10. Thus, water jacket 18 is formed around only the upper portion of cylinder walls 12, and is made shallow in depth in the vertical direction. With this shallow depth, water jacket 18 is capable of effectively cooling the upper portion of cylinder walls 12 which is near a combustion chamber of the engine. Besides, since side jacket wall 14 is not formed around the lower portion of cylinder walls 12, cylinder block 10 can be decreased in weight, and can prevent an excessive cooling of cylinder walls 12. Thus, cylinder block 10 can improve fuel efficiency, emission reduction, heater performance and other properties of the vehicle.

A head gasket is to be provided on top deck 20, and a cylinder head is to be fastened immovably to top deck 20 with head bolts. Thus, the head gasket is to be held between the cylinder head and top deck 20. As shown in FIGS. 2 and 3, side jacket wall 14 includes head bolt bosses 36 at positions in four directions around each of cylinder bores 11. In other words, in side jacket wall 14, head bolt bosses 36 are located between adjacent cylinder bores 11 and at both ends of the series of cylinder bores 11 arranged in line in the longitudinal direction. The head bolts are to be each inserted or screwed into head bolt bosses 36. Each of head bolt bosses 36 includes an upper end having an opening or head bolt hole in top deck 20, and a lower end extending to the vicinity of jacket bottom wall 16 in the vertical direction of cylinder block 10. Each of head bolt bosses 36 is formed in a substantially cylindrical thick-walled form, and bulges outward in the lateral direction of cylinder block 10.

Cylinder block 10 also includes a crankcase 24 below lower deck 22. Crankcase 24 has a half-skirt form hanging down from lower deck 22, and includes cap-mounting bulk portions 74 each of which to receive a bearing cap 76. Bearing cap 76 is a member formed separately from cylinder block 10. Bearing cap 76 and cap-mounting bulk portion 74 are to be jointly fastened to each other with cap fastening bolts to sandwich a crankshaft, and thereby to rotatably support the crankshaft. Each of cap-mounting bulk portions 74 includes bolt holes 75. The cap fastening bolt is to be screwed into each of bolt holes 75.

Cap-mounting bulk portions 74 are arranged in line in the longitudinal direction of cylinder block 10 at substantially regular intervals between the adjacent cylinders and at both ends of the series of the cylinders arranged in line in the longitudinal direction, as shown in FIG. 1. Each of cap-mounting bulk portions 74 is formed integrally with both left and right side walls 25 of crankcase 24 under the lower end of the cylinder wall 12. Thus, each of cap-mounting bulk portions 74 has a substantially plate form extending between and connecting with inside surfaces of both side walls 25. Each of cap-mounting bulk portions 74 includes a cap-mounting recess portion 78 receding upward from a flat level of a lower surface of the cap-mounting bulk portion 74. Bearing cap 76 includes an upper end formed with an upper flange portion 77 projecting outward in the lateral direction of cylinder block 10, as shown in FIG. 4. Upper flange portion 77 is fitted into cap-mounting recess portion 78. Cap-mounting recess portion 78 and upper flange portion 77 include shaft bearing semicylindrical surfaces 79 and 80, respectively. Shaft bearing semicylindrical surfaces 79 and 80 rotatably support the crankshaft, when cap-mounting recess portion 78 and upper flange portion 77 are fitted together. Cap-mounting recess portion 78 includes a rounded corner 81 having an arc-shaped vertical section at each outer end, to fit with a similarly rounded corner of upper flange portion 77. Crankcase 24 includes an oil pan rail 82 integrally formed at a lower end of crankcase 24. An oil pan is to be mounted on oil pan rail 82. The lower surfaces of cap-mounting bulk portion 74 and oil pan rail 82 are located in a substantially even plane, and form a lowermost surface of cylinder block 10.

Cylinder block 10 also includes bulk connection portions 83 each connecting cap-mounting bulk portion 74 and side wall 25 integrally with each other. Each of bulk connection portions 83 projects inward from side wall 25, and has an outline of a thick wall bulging inward, as shown in FIG. 1. However, each of bulk connection portions 83 includes a hollow portion 84 extending in the vertical direction of cylinder block 10, and thereby is made hollow. As shown in FIGS. 2 and 3, hollow portion 84 extends downward from the vicinity of lower deck 22, and forms a cast hole opening to the lower surface of cylinder block 10. As shown in FIG. 1, each of bulk connection portions 83 has a V-shaped or triangular angle rib form composed of rib portions 86 and 87 extending laterally inward from side wall 25 and meeting each other at a meeting or crossing point 90. Thus, the V-shaped angle rib form of bulk connection portion 83 has a V-shaped or triangular cross section tapered laterally inward from side wall 25. Rib portions 86 and 87 meet each other at crossing point 90 forming a support portion gently connecting to cap-mounting bulk portion 74. Hollow portion 84 is formed between rib portions 86 and 87 and side wall 25. Rib portions 86 and 87, or imaginary extension lines indicated by broken lines in FIG. 1, cross each other at crossing point 90 near side wall 25 outside either end of cap-mounting recess portion 78. Thus, crossing point 90 does not adjoin or overlap cap-mounting recess portion 78.

As shown in FIGS. 2 and 3, cylinder block 10 also includes connecting ribs each having a pair of connecting rib portions 88 arranged in the longitudinal direction at each side of cylinder block 10. Connecting rib portions 88 connect head bolt boss 36 at either side with bulk connection portion 83 at the same side substantially with each other in the vertical direction of cylinder block 10. Each of connecting rib portions 88 has a substantially plate form spreading out laterally downward from the side wall of cylinder block 10 to outer ends of lower deck 22 as shown in FIG. 2. Thus, each of connecting rib portions 88 has a sectional size becoming laterally larger from side jacket wall 14 to lower deck 22. Connecting rib portions 88 extend vertically in parallel with each other along downward imaginary extensions of both front and rear edges of head bolt boss 36 in the vertical direction of cylinder block 10 as shown in FIG. 3.

Each of connecting rib portions 88 has an upper end connected to jacket bottom wall 16 and a lower end connected to lower deck 22. A space surrounded by connecting rib portions 88, jacket bottom wall 16 and lower deck 22 form a cast hole opening in the side of cylinder block 10. As shown in FIG. 3, water jacket 18 and head bolt bosses 36 are formed above jacket bottom wall 16, and crankcase 24 is formed below lower deck 22. Therefore, a middle portion extending vertically between jacket bottom wall 16 and lower deck 22, especially at a part as shown in FIG. 3 between cylinder bores 11, forms a large inward recession. Therefore, connecting rib portions 88 provided at a part corresponding to the recession are large in size, as shown in FIG. 3.

Thus, in this embodiment, each of bulk connection portions 83 connecting cap-mounting bulk portion 74 and side wall 25 projects inward to have a wall thickness, and has a closed cross section including hollow portion 84. Besides, each of these bulk connection portions 83 and head bolt bosses 36 provided in side jacket wall 14 are connected with each other in the vertical direction by connecting rib portions 88. Thus, cylinder block 10 of this embodiment can effectively increase strength or rigidity of bulk connection portions 83 by utilizing existing head bolt bosses 36. As mentioned above, bulk connection portions 83 are likely to undergo intensive stress originating from a large magnitude of firing pressure and inertial force from the crankshaft. However, with the increased strength or rigidity, bulk connection portions 83 can bear such intensive stress. Besides, since each of bulk connection portions 83 includes hollow portion 84, cylinder block 10 of this embodiment can be reduced in weight, compared to when each of bulk connection portions has a solid structure without hollow portion 84, and also can prevent the occurrence of cast defects, such as shrinkage.

Since each of bulk connection portions 83 is formed in the V-shaped angle rib form formed by rib portions 86 and 87, bulk connection portion 83 is likely to undergo the stress concentrated on crossing point 90 of rib portions 86 and 87. If crossing point 90 adjoins or overlaps cap-mounting recess portion 78, the stress may be concentrated on a part at which cap-mounting recess portion 78 and bearing cap 76 are fitted to each other. By contrast, cylinder block 10 of this embodiment sets crossing point 90 outside cap-mounting recess portion 78, and thereby prevents stress concentration on the part where cap-mounting recess portion 78 is to be fitted with bearing cap 76.

Some of hollow portions 84 are used as oil drain passages 84A. Thus, compared to a structure including hollow portions and oil drain passages as different members, cylinder block 10 of this embodiment has a simple structure. Each of hollow portions 84A used as oil drain passages is extended upward in the vertical direction of cylinder block 10, and has an upper end opening to top deck 20, as indicated by broken lines 91 in FIG. 2.

As shown in FIGS. 1 and 3, cap-mounting bulk portions 74 and bulk connection portions 83 each have substantially symmetrical forms with respect to an imaginary center plane L1 containing a central axis of the crankshaft. Thus, each of cap-mounting bulk portions 74 is made of material having an equal volume on right and left sides of the imaginary center plane L1. Therefore, cap-mounting bulk portion 74 undergoes no difference in thermal expansion on the right and left sides of the imaginary center plane L1, and causes no concentration of stress originating from such difference in thermal expansion.

Cylinder block 10 of this embodiment sets the form and size of cap-mounting bulk portions 74 in accordance with the form and size of bearing cap 76 so as to prevent the occurrence of difference in thermal expansion between cap-mounting recess portion 78 and upper flange portion 77 when fitted together. Therefore, cylinder block 10 of this embodiment can prevent stress concentration caused by such thermal expansion difference on the part at which cap-mounting recess portion 78 is to be fitted with upper flange portion 77.

Cylinder block 10 of this embodiment is to be provided for the inline four-cylinder internal-combustion engine. However, cylinder block 10 may be provided for other type of internal-combustion engine, such as an inline six-cylinder internal-combustion engine.

This application is based on a prior Japanese Patent Application No. 2003-351579 filed on Oct. 10, 2003. The entire contents of this Japanese Patent Application No. 2003-351579 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A cylinder block for an internal-combustion engine, comprising:

an upper block wall surrounding an upper part of a cylinder of the engine, and including first and second upper side walls on first and second sides of the cylinder;

a crankcase including first and second side walls formed, respectively, on the first and second sides;

first and second head bolt bosses formed, respectively on first and second sides, each head bolt boss projecting from the upper block wall and including a head bolt hole opening in a top deck of the cylinder block;

a cap-mounting bulk portion extending between the first and second side walls of the crankcase, and arranged to support a crankshaft rotatably with a bearing cap;

first and second bulk connection portions projecting, respectively, from the first and second side walls of the crankcase, to the cap-mounting bulk portion, and thereby connecting the cap-mounting bulk portion, respectively with the first and second side walls of the crankcase, each of the first and second bulk connection portions being formed with a hollow portion extending in a vertical direction of the cylinder block; and first and second connecting ribs extending in the vertical direction and connecting the first and second bulk connection portions, respectively, with the first and second head bolt bosses.

2. The cylinder block as claimed in claim 1, wherein each of the bulk connection portions includes a support portion supporting one end of the cap-mounting bulk portion, and rib portions extending obliquely from one of the side walls to the support portion so as to form a triangular cross section, and defining the hollow portion between the rib portions.

3. The cylinder block as claimed in claim 2, wherein the cap-mounting bulk portion includes a cap-mounting recess portion receding upward from a lower surface of the cap-mounting bulk portion to receive an upper flange portion of the bearing cap; and the rib portions meet each other at a position outside the cap-mounting recess portion.

4. The cylinder block as claimed in claim 1, wherein the cap-mounting bulk portion is divided into left and right halves which are equal to each other in volume, by an imaginary center plane containing a central axis of the crankshaft.

5. The cylinder block as claimed in claim 1, wherein each of the upper block wall, the crankcase, the first and second head bolt bosses, the cap-mounting bulk portion, the first and second bulk connection portions and the first and second connecting ribs is substantially symmetrical in a manner of bilateral symmetry with respect to an imaginary center plane containing a central axis of the crankshaft.

6. The cylinder block as claimed in claim 1, wherein at least one of the hollow portions is used as an oil drain passage extended upward in the vertical direction, and having an opening to the top deck.

7. The cylinder block as claimed in claim 1, wherein each of the first and second connecting ribs includes rib portions extending in parallel with each other from the upper block wall to a lower deck above the crankcase in the vertical direction, each of the rib portions having a sectional size becoming larger from the upper block wall to the lower deck.

8. The cylinder block as claimed in claim 7, further comprising a water jacket formed between the upper part of the cylinder and the upper block wall, and surrounding the upper part of the cylinder; and a jacket bottom wall formed at a bottom of the water jacket, and connecting a middle portion of the cylinder and a lower end of the upper block wall; wherein the rib portions extend in parallel with each other from the jacket bottom wall to the lower deck in the vertical direction, each of the rib portions having a sectional size becoming larger from the jacket bottom wall to the lower deck.

9. An internal-combustion engine, comprising:

a cylinder block including, an upper block wall surrounding an upper part of a cylinder of the engine, and including first and second upper side walls on first and second sides of the cylinder, a crankcase including first and second side walls formed, respectively, on the first and second sides, first and second head bolt bosses formed, respectively on first and second sides, each head bolt boss projecting from the upper block wall and including a head bolt hole opening in a top deck of the cylinder block, a cap-mounting bulk portion extending between the first and second side walls of the crankcase, first and second bulk connection portions projecting, respectively, from the first and second side walls of the crankcase, to the cap-mounting bulk portion, and thereby connecting the cap-mounting bulk portion, respectively with the first and second side walls of the crankcase, each of the first and second bulk connection portions being formed with a hollow portion extending in a vertical direction of the cylinder block, and first and second connecting ribs extending in the vertical direction and connecting the first and second bulk connection portions, respectively, with the first and second head bolt bosses; and a bearing cap fitted to the cap-mounting bulk portion and supporting a crankshaft rotatably with the cap-mounting bulk portion.

* * * * *